US005713221A

United States Patent [19]

Myers et al.

[11] Patent Number: 5,713,221

[45] Date of Patent: Feb. 3, 1998

[54] OPTICAL OUT-OF-BALANCE SENSOR FOR A WASHER

[75] Inventors: Sean F. Myers, Webster City; William Hughett, Fort Doge, both of Iowa

[73] Assignee: White Consolidated Industries, Inc., Cleveland, Ohio

[21] Appl. No.: 702,220

[22] Filed: Aug. 23, 1996

[51] Int. Cl.[6] ..... D06F 33/02

[52] U.S. Cl. ..... 68/12.06; 68/23.3

[58] Field of Search ..... 68/12.06, 23.1, 68/23.3; 210/144

[56] References Cited

U.S. PATENT DOCUMENTS

| | | | |
|---|---|---|---|
| 3,583,182 | 6/1971 | Matsuura et al. | 68/23.1 |
| 4,098,098 | 7/1978 | Altnau | 210/144 X |
| 4,449,383 | 5/1984 | Cartier | 68/23.3 X |
| 4,677,291 | 6/1987 | Ellingson | 68/23.1 X |
| 4,742,698 | 5/1988 | Torita | 68/23.3 X |
| 5,083,447 | 1/1992 | Kiuchi et al. | 68/12.05 |
| 5,269,159 | 12/1993 | Oh | 68/12.06 |
| 5,375,437 | 12/1994 | Dausch et al. | 68/12.06 |
| 5,561,990 | 10/1996 | Berkcan et al. | 68/23.3 X |

FOREIGN PATENT DOCUMENTS

| | | |
|---|---|---|
| 3-80898 | 4/1991 | Japan . |
| 5-154276 | 6/1993 | Japan . |

OTHER PUBLICATIONS

English abstract of Japanese Patent No. 5–154276 (1993).

English abstract of Japanese Patent No. 3–80898 (1991).

*Primary Examiner*—Philip R. Coe

*Attorney, Agent, or Firm*—Pearne, Gordon, McCoy & Granger LLP

[57] ABSTRACT

A washing machine includes a cabinet, a splash tub located within the cabinet, and a support system resiliently supporting the splash tub relative to the cabinet. A spin tub is located within the splash tub and a drive system spins the spin tub about an axis of rotation during a spin cycle. A sensor detects an out-of-balance condition during the spin cycle characterized by oscillations of the splash tub. The sensor includes a target attached to the cabinet having a reflecting surface, a light source attached to the splash tub and positioned to direct infra red light toward the reflecting surface, and a light receiver attached to the splash tub and positioned to receive infra red light reflected from the reflecting surface. The reflecting surface has a pattern of varying reflectivity so that the light receiver receives a different quantity of infra red light when the splash tub moves relative to the cabinet. The sensor produces an output signal proportional to an amount of infra red light received by the light receiver. The output signal is sent to a microprocessor which reduces the rate of spinning of the spin tub when the output signal is at a predetermined level.

17 Claims, 2 Drawing Sheets

OPTICAL OUT-OF-BALANCE SENSOR FOR A WASHER

BACKGROUND OF THE INVENTION

1. Field of the Invention

The present invention generally relates to washing machines and, more particularly, to washing machines having out-of balance sensors.

2. Description of Related Art

An out-of-balance condition can occur in a typical domestic washing machine when articles to be cleansed, such as clothes and the like, bunch up asymmetrically at various locations in a spinning basket or spin drum which holds the articles. The out-of-balance condition, which is characterized by oscillations or excursions of a splash tub which encloses the spin tub, can be detrimental to the washing machine if left uninterrupted. For example, the splash tub may violently strike a washing machine cabinet enclosing the splash tub and cause damage to the splash tub, the cabinet, or both. Additionally, unacceptable stresses can develop in components of the washing machine such as, for example, a suspension system for the splash tub or a transmission which links a motor to the spin tub.

Some washing machines include an out-of-balance switch or combination open lid/out-of-balance switch which in either case deenergizes the motor during high speed spin if a single excursion of the splash tub reaches a point where the splash tub mechanically trips the switch. A drawback of this approach is that the mechanical switch is susceptible to unnecessarily interrupting operation of the washing machine because only a single excursion of the splash tub is required to trip the out-of-balance switch. The operation of the washing machine, therefore, can be mistakenly interrupted and/or extended when there is not an actual detrimental or harmful out-of-balance condition.

Other washing machines include a microprocessor which provides control of the washing machine. The microprocessor can detect an out-of-balance and take suitable corrective action to interrupt the out-of-balance condition. The microprocessor typically detects an out-of-balance condition by monitoring changes in the torque, current, and/or power of the motor spinning the spin tub. A drawback of this approach is that elaborate logic is required to cooperate with the microprocessor which adds to the complexity and cost of the washing machine. Accordingly, there is a need in the art for a washing machine having an out-of-balance sensor which minimizes false interruptions, is relatively simple to manufacture, and is relatively inexpensive.

SUMMARY OF THE INVENTION

The present invention provides a washing machine having a sensor for detecting an out-of-balance condition during a spin cycle which overcomes at least some of the above-noted problems of the related art. The out-of-balance condition is characterized by oscillations or excursions of a splash tub. The washing machine includes a cabinet in which the splash tub is located, a support system resiliently supporting the splash tub relative to the cabinet, a spin tub located within the splash tub and having an axis of rotation, and a drive system for spinning the spin tub about the axis of rotation during the spin cycle. The sensor includes a target attached to the cabinet having a reflecting surface, a light source attached to the splash tub and positioned to direct light toward the reflecting surface, and a light receiver positioned to receive light directed from the light source and reflected from the reflecting surface to indicate relative movement between the splash tub and the target.

Preferably, the reflecting surface has a pattern of varying reflectivity so that a different quantity of light is reflected from the light source to the light receiver when the light source moves relative to the target, thus indicating relative movement between the splash tub and the cabinet. The sensor sends an output signal which is proportional to the amount of light received by the light receiver to a microcontroller. The microprocessor takes corrective action to interrupt the out-of-balance condition, such as reducing the speed of the spin tub, stopping the spin tub, and/or sounding an alarm, when the output signal from the sensor reaches a predetermined level which indicates an out-of-balance condition. Unnecessary interruptions can be reduced by requiring the output signal from the sensor to reach the predetermined level, a predetermined number of times within a predetermined period of time before corrective action is taken.

BRIEF DESCRIPTION OF THE DRAWINGS

These and further features of the present invention will be apparent with reference to the following description and drawings, wherein.

DETAILED DESCRIPTION OF THE PREFERRED EMBODIMENT

Figure 1:
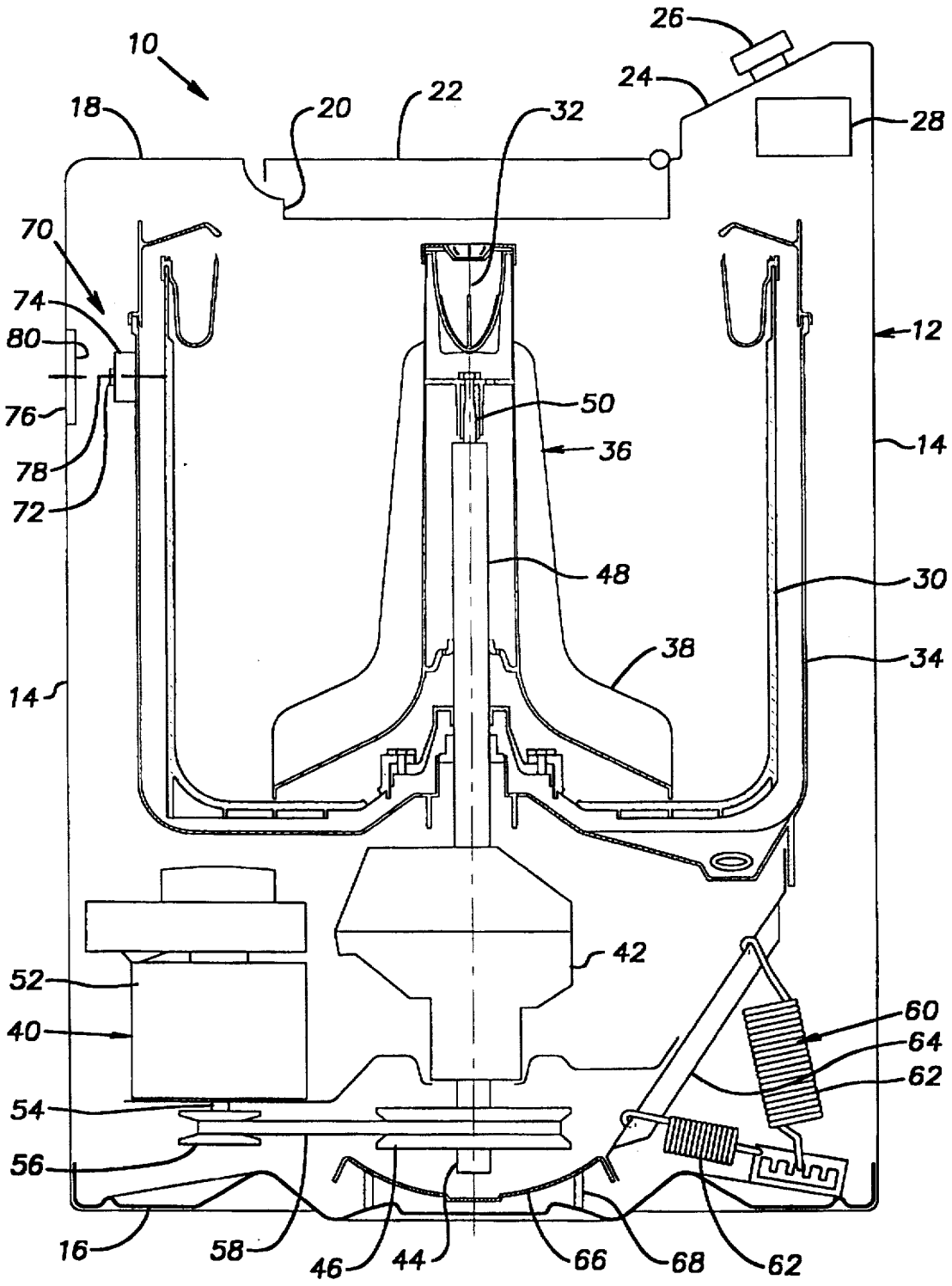
FIG. 1 is a side elevational view, in partial cross-section, of a washing machine according to the present invention.

FIG. 1 schematically illustrates a domestic clothes washing machine 10 according to the present invention. The washing machine 10 includes a boxlike cabinet 12 formed of a plurality of sheet metal panels which form four vertically extending sidewalls 14 (only two shown), a bottom or base wall 16, and a top wall 18. The top wall 18 is provided with an access opening 20 and a pivotally mounted door 22 for selectively closing the access opening 20. Clothes or other articles to be cleansed are loaded and unloaded through the access opening 20 into the interior of the cabinet 12. A control console 24 is provided at the rear of the top wall which includes a control knob 26 or other suitable control device which allows a user to select one of several predetermined sequences of cycles for the washing machine 10. A microprocessor or microcontroller 26 controls the selected sequence of cycles.

The articles are loaded through the access opening 20 into a perforated inner or spin tub 30 which rotates about a vertical spin axis 32 to centrifugally extract wash fluids from the articles during a spin cycle. The spin tub 30 is surrounded by an imperforate outer or splash tub 34 to contain the wash and rinse water. An agitator 36 is located within the spin tub 30 and has a series of upstanding vanes 38 formed thereon. The agitator 36 oscillates about the spin axis 32 to agitate or scrub the articles to be cleansed during, for example, wash and rinse cycles.

A drive system 40 includes a belt driven transmission 42 which both oscillates the agitator 36 and spins the spin tub 30. The transmission 42 includes at its lower end an input shaft 44 which has a driven pulley 46 attached thereto, an output tube 48 attached to the spin tub, and an output shaft 50 extending through the output tube 48 and attached to the agitator 36. A reversible electric motor 52 includes a vertical axis output shaft 54 with a drive pulley 56 attached thereto. The motor output shaft 54 rotatably drives the transmission input shaft 44 via a drive belt 58 extending around the pulleys 46, 56. The transmission 42 has two alternative modes of operation depending on the direction of rotation of the motor output shaft 54 as is known in the art. When the motor output shaft 54 is rotated in one direction, the transmission 42 operates to oscillate the agitator 36 within the spin tub 30. When the motor output shaft 54 is rotated in the other direction, the transmission 42 operates to spin the spin tub 30 within the splash tub 34.

Inside the cabinet 12, the splash tub 34 is supported by a resilient support system 60 which provides mechanical support and isolation with respect to the cabinet 12 for components such as the spin tub 30, the splash tub 34, the transmission 42, and the motor 52. The support system 60 includes springs 62, struts 64, a snubber dome 66, and an annular shuttle member or ring 68. The struts 64 transfer the weight of the splash tub 34 to the base wall 16 via the snubber dome 66 and the annular ring 68. During operation of the washing machine 10, the snubber dome 66 moves laterally on the annular ring 68 to accommodate unbalanced loads as is more fully described in U.S. Pat. Nos. 3,269,544 and 3,493,188 which are expressly incorporated herein in their entirety by reference. The illustrated support system 60 is provided as an example of known support systems and the present invention is not limited to washing machines having such a support system.

Once the articles to be cleansed are loaded through the access opening 20 into the spin tub 30, the operator initiates the desired sequence of cycles. Typically, the sequence of cycles includes filling the splash tub 34 with wash water, oscillating the agitator 36 so that the vanes 38 engage and mix the articles and wash fluid within the spin tub 30, draining wash fluid from the splash tub 34, filling and draining the splash tub 34 one or more times with rinse water, and spinning the spin tub 30 at a relatively high speed to centrifugally extract water from the articles therein. It is submitted that the foregoing generally describes a rather well-known or conventional washing machine assembly, and is provided herein only to clarify the environment in which the present invention, to be described hereafter, is employed.

During the spin cycle, an out-of-balance condition can arise wherein the articles asymmetrically bunch up at various height locations in the spin tub 30. The resulting load imbalance, in combination with the centrifugal force generated during the spin cycle, may cause the splash tub 34 to uncontrollably oscillate. The oscillations are typically characterized by excursions of the splash tub 34 in a direction generally parallel to the axis of rotation 32 of the spin tub 30. The uncontrollable oscillation can cause the splash tub 34 to strike the cabinet 12 as well as cause undue stress on various components of the washing machine 10 such as the transmission 42 and the support system 60. It should be appreciated that the forgoing out-of-balance condition can develop regardless of the specific orientation of the spin axis 32 and thus the present invention can be effectively used in either top or front loading washing machines.

The washing machine 10 includes an out-of-balance sensor 70 for detecting if and by how much the articles within the spin tub 30 are out of balance. The illustrated out-of-balance sensor 70 is located at the front of the washing machine 10. It is noted that the out-of-balance sensor 70 can be located at other positions and only one out-of balance sensor 70 is required. Upon detecting an unacceptable out-of-balance condition, the spin speed of the spin tub 30 is either slowed or stopped to prevent damage to the various components of the washing machine 10.

The out-of balance sensor 70 includes a light source 72, a light detector or receiver 74, and a target 76. The light source 72 is mounted to the outer surface of the splash tub 34 at a top portion of the splash tub 34. It is noted that the light source 72 alternatively could be mounted on the cabinet 12 if the target is mounted on the splash tub 34. The light source 72 is positioned to emit a beam of light 78 generally perpendicular to the sidewall 14 of the cabinet 12. The illustrated light source 72 emits a light beam which is generally horizontal and is generally perpendicular to the sidewall 14 at the front end of the washing machine 10. The light source 72 is preferably an infrared light emitting diode (IRLED) but can provide light with a different wavelength such as visible light or can be another type of infrared light source.

The light receiver 74 is also mounted to the outer surface of the splash tub 34 at top portion of the splash tub 34 and adjacent the light source 72. The light receiver 74 is positioned to receive light emitted from the light source 72 and reflected by the target 76. In the illustrated embodiment, the light receiver 74 receives light along a path generally perpendicular to the sidewall 14 of the cabinet 12. The light receiver 74 is capable of detecting light at a wavelength equal to the wavelength of the light emitted by the light source 72. A suitable IRLED light source 72 and light receiver 74 can be obtained form Sharp Electronics Corporation, Mahwah, N.J.

Figure 2:
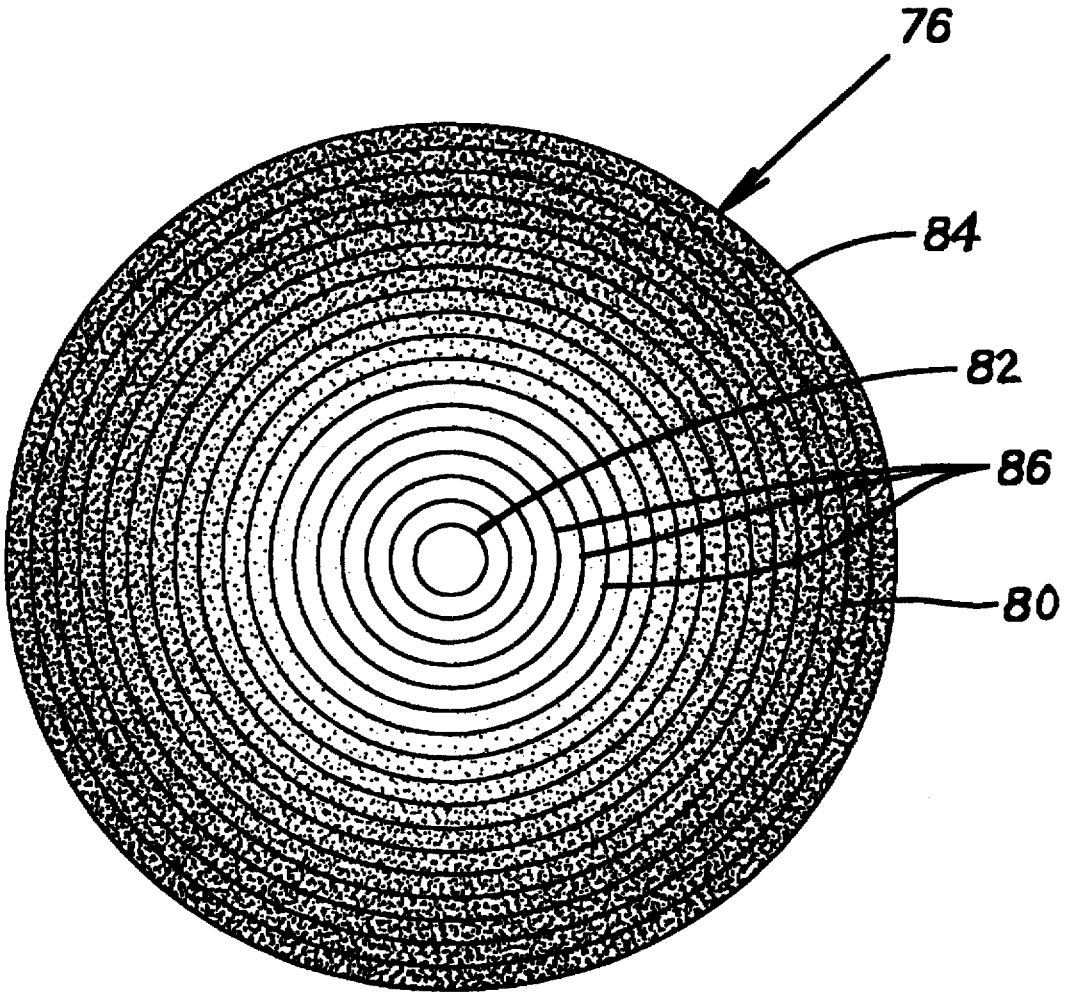
FIG. 2 is an enlarged view of a target of the washing machine of FIG. 1.

The target 76 is mounted to the inner surface of the cabinet 12 directly in the path and substantially perpendicular to the light beam 78 emitted from the light source 72, that is, opposite the light source 72. The target 76 includes a reflecting surface 80 having a pattern with different levels of reflectivity, at the wavelength of the light emitted by the light source 72. The pattern of the reflecting surface 80 is arranged to indicate relative movement between the target 76 and the light source 72. As shown in FIG. 2, the pattern is preferably a bull's eye, that is a series of concentric circles 82, 84, 86 having increasing or decreasing shades of gray or color. The illustrated pattern has a white center circle 82, a black outer peripheral circle 84, and circles 86 of increasing shades of gray therebetween. The reflecting surface 80 can have other types of patterns such as, for example, a V-shaped pattern. The target 76 preferably comprises a sheet of paper or laminate with the pattern printed on one side.

The target 76 is positioned so that light emitted from the light source 72 strikes the center of the target 76 when the washing machine 10 is not in an out-of-balance condition. When the washing machine 10 is in an out-of-balance condition, the light source 72 moves or oscillates along with the splash tub 34 so that the beam of light moves around the target 76 with a displacement from the center of the target 76. As the beam of light moves around the target 76, the amount of reflected light changes according to the shaded areas of the target 76. When the light beam from the light source 72 strikes a light area, a relatively large amount of light will be reflected by the target 76 and received by the light receiver 74 so that the out-of balance sensor 70 has a strong output signal. When the light beam from the light source 72 strikes a dark area, a relatively small amount of light is reflected by the target 76 and received by the light receiver 74 so that the out-of-balance sensor 70 has a weak output signal.

The output signal from the out-of-balance sensor 70 is sent to the microcontroller 26 which determines the degree to which the articles are in an out-of-balance condition. The amplitude of the splash tub 34 oscillation is determined from the amount of change in the output signal of the out-of-balance sensor 70. The microcontroller 26 takes predetermined corrective action when the amplitude of the oscillation reaches a predetermined level for a predetermined period of time. For example, the microcontroller 26 can reduce or stop the spin rate of the spin tub 30 to reduce or eliminate the out-of balance-condition and/or sound an alarm. The above described out-of-balance sensor 70 can be easily added onto existing washing machines wherein the existing microcontrollers of electronically controlled machines are utilized and add-on circuits are utilized in electromechanically controlled washing machines.

Although particular embodiments of the invention have been described in detail, it will be understood that the invention is not limited correspondingly in scope, but includes all changes and modifications coming within the spirit and terms of the claims appended hereto.

What is claimed is:

1. A washing machine:

a cabinet;

a splash tub located within said cabinet;

a support system resiliently supporting said splash tub relative to said cabinet;

a spin tub located within said splash tub and having an axis of rotation;

a drive system for spinning said spin tub about said axis of rotation during a spin cycle; and a sensor for detecting an out-of-balance condition characterized by oscillations of said splash tub during said spin cycle, said sensor including a target attached to one of said cabinet and said splash tub and having a reflecting surface, a light source attached to the other of said cabinet and said splash tub and positioned to direct light toward said reflecting surface, and a light receiver positioned to receive light directed from said light source and reflected from said reflecting surface to indicate relative movement between said splash tub and said cabinet.

2. The washing machine according to claim 1, wherein said target is attached to said cabinet and said light source is attached to said splash tub.

3. The washing machine according to claim 1, wherein said target has a pattern of varying reflectivity such that a change in light reflected from said reflecting surface to said light receiver indicates relative movement between said splash tub and said cabinet.

4. The washing machine according to claim 3, wherein said pattern is a bull's eye.

5. The washing machine according to claim 3, wherein said pattern has a series of concentric circles with increasing shades of darkness in a radial direction.

6. The washing machine according to claim 5, wherein said pattern has a white center circle, a black outer peripheral circle, and circles of outwardly increasing shades of gray therebetween.

7. The washing machine according to claim 3, wherein said sensor produces an output signal proportional to an amount of light received by said light receiver.

8. The washing machine according to claim 7, further comprising a microprocessor in electrical communication with said sensor to receive said output signal of said sensor and with said drive system to reduce a rate of spinning of said spin tub responsive to a predetermined level of said output signal.

9. The washing machine according to claim 1, wherein said light receiver is attached to said splash tub.

10. The washing machine according to claim 1, wherein said light source produces infra red light.

11. The washing machine according to claim 10, wherein said light source is an IRLED.

12. The washing machine according to claim 1, further comprising a microprocessor in electrical communication with said sensor to receive an output signal of said sensor and with said drive system to reduce a rate of spinning of said spin tub responsive to a predetermined level of said output signal.

13. The washing machine according to claim 12, wherein said output signal is proportional to an amount of light received by said light receiver.

14. A washing machine:

a cabinet;

a splash tub located within said cabinet;

a support system resiliently supporting said splash tub relative to said cabinet;

a spin tub located within said splash tub and having an axis of rotation;

a drive system for spinning said spin tub about said axis of rotation during a spin cycle;

a sensor for detecting an out-of-balance condition characterized by oscillations of said splash tub during said spin cycle, said sensor including a target attached to said cabinet having a reflecting surface, a light source attached to said splash tub and positioned to direct light toward said reflecting surface, and a light receiver positioned to receive light directed from said light source and reflected from said reflecting surface, said reflecting surface having a pattern of varying reflectivity so that said light receiver receives a different quantity of light when said splash tub moves relative to said cabinet, said sensor producing an output signal proportional to an amount of light received by said light receiver; and a microprocessor in electrical communication with said sensor to receive said output signal and with said drive system to reduce a rate of spinning of said spin tub responsive to a predetermined level of said output signal.

15. The washing machine according to claim 14, wherein said light receiver is attached to said splash tub.

16. The washing machine according to claim 14, wherein said light source produces infra red light.

17. The washing machine according to claim 16, wherein said light source is an IRLED.

* * * * *